US007784730B2

(12) United States Patent
Heimrich et al.

(10) Patent No.: US 7,784,730 B2
(45) Date of Patent: Aug. 31, 2010

(54) DEVICE FOR COVERING A DANGER AREA ON A ROLL CHANGER AND A METHOD FOR CONTROLLING A DEVICE

(75) Inventors: Bernd Rudolf Heimrich, Gochsheim (DE); Martin Richard Keller, Karlstadt (DE); Walter Ritter, Grünsfeld (DE); Franz Josef Vorwerk, Zellingen (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 291 days.

(21) Appl. No.: 11/988,075

(22) PCT Filed: Oct. 10, 2006

(86) PCT No.: PCT/EP2006/067227

§ 371 (c)(1),
(2), (4) Date: Dec. 28, 2007

(87) PCT Pub. No.: WO2007/096007

PCT Pub. Date: Aug. 30, 2007

(65) Prior Publication Data

US 2009/0127375 A1 May 21, 2009

(30) Foreign Application Priority Data

Feb. 20, 2006 (DE) ..... 10 2006 008 104

(51) Int. Cl.
*B65H 19/00* (2006.01)

(52) U.S. Cl. ..... 242/599; 242/599.2; 242/563

(58) Field of Classification Search ..... 242/559, 242/559.2, 563; 160/9, 127, 311
See application file for complete search history.

(56) References Cited

U.S. PATENT DOCUMENTS

| | | | | |
|---|---|---|---|---|
| 5,050,271 | A | 9/1991 | Hosel | |
| 6,006,670 | A * | 12/1999 | Bantlin et al. | 101/494 |
| 6,007,017 | A * | 12/1999 | Vorwerk | 242/563 |
| 6,039,284 | A * | 3/2000 | Lehrieder et al. | 242/559 |
| 6,138,938 | A * | 10/2000 | Lehrieder et al. | 242/559.3 |
| 6,644,192 | B2 | 11/2003 | Dilling et al. | |

(Continued)

FOREIGN PATENT DOCUMENTS

| | | |
|---|---|---|
| CH | 377250 | 6/1964 |

(Continued)

*Primary Examiner*—Sang Kim
(74) *Attorney, Agent, or Firm*—Jones, Tullar & Cooper, P.C.

(57) ABSTRACT

A device is provided for use in covering a danger area on a roll changer that can carry at least one roll of material to be directed to a rotary, web-fed printing press. A cover is provided with a drive that can move the cover. A control unit is provided to control the drive for the cover. The cover is closed in a first operational state and is open in a second operational state. The roll of material, that is supported by the roll changer, has a first rotational speed or web speed when the cover is in the first, closed operational state. In the second, cover opened, operational state, the roll of material also has a second rotational or web speed which is greater than zero. A method for controlling a device on a roll changer is also disclosed.

41 Claims, 4 Drawing Sheets

U.S. PATENT DOCUMENTS

| | | | | |
|---|---|---|---|---|
| 6,953,172 | B2 | 10/2005 | Moser | |
| 7,073,788 | B2 | 7/2006 | Donges et al. | |
| 7,134,625 | B2 * | 11/2006 | Lehrieder et al. | 242/559.2 |
| 2003/0131738 | A1 * | 7/2003 | Hendrix | 100/161 |
| 2007/0170298 | A1 | 7/2007 | Lehrieder et al. | |

FOREIGN PATENT DOCUMENTS

| | | | |
|---|---|---|---|
| DE | 253 006 | | 9/1986 |
| DE | 39 12 737 | | 10/1990 |
| DE | 296 02 098 | | 3/1996 |
| DE | 100 08 221 | | 8/2001 |
| DE | 101 50 810 | | 4/2003 |
| DE | 103 31 755 | A1 | 3/2004 |
| DE | 103 46 984 | | 5/2005 |
| GB | 914384 | | 1/1963 |
| WO | WO 2005/080241 | | 9/2005 |

* cited by examiner

DEVICE FOR COVERING A DANGER AREA ON A ROLL CHANGER AND A METHOD FOR CONTROLLING A DEVICE

CROSS-REFERENCE TO RELATED APPLICATIONS

This application is the U.S. national phase, under 35 USC 371, of PCT/EP2006/067227, filed Oct. 10, 2006; published as WO 2007/096007 A1 on Aug. 30, 2007, and claiming priority to DE 10 2006 008 104.8, filed Feb. 20, 2006, the disclosures of which are expressly incorporated herein by reference.

FIELD OF THE INVENTION

The present invention is directed to a device for covering a danger area on a roll changer and also to a method for controlling such a device. The roll changer supports at least one material roll and has a protective cover. A drive is provided to move the protective cover. A control unit is used to control the drive for the protective cover.

BACKGROUND OF THE INVENTION

A process of providing a zone safety system to ensure operational safety in the area around large moved material rolls is known from WO 2005/080241 A2. To accomplish this process, an installation of fencing around the perimeter of a material roll warehouse is proposed. A lock on an automatic roll changer can be provided for the zone safety system. The zone safety system preferably operates in a contactless manner, for example by using photoelectric sensors or ultrasound sensors. By positioning such sensors at varying heights, complex scanning routines can be implemented. Material rolls are able to pass the lock without problems, whereas an unauthorized passage through the sensor signals will trigger an alarm and/or will operate to stop the movement of the material rolls, in order to prevent accidents. Zone safety systems of this type have traditionally been installed to prevent the collision of persons with the heavy material rolls, which heavy material rolls, at times, move very rapidly.

Various standards prescribe a zone safety system in danger zones. These include, for example, DIN EN 1010, directed to safety of machinery and which sets forth safety requirements for the design and construction of printing and paper processing machines, as set forth in the overlay, publication information, table of contents, foreword, and pages 29 through 34 thereof, and in which various zone safety systems are described.

Because of new width ranges in newspaper printing or also in commercial printing, and beyond a certain paper width and web speed, core bursts can occur. In such an occurrence, flying core pieces can injure operating personnel or can damage other machinery. This danger exists especially above a paper web width of greater than approximately 2,000 mm, a web speed especially of more than 10 m/s, and particularly above a cardboard core diameter of approximately 76 mm. With the traditional zone safety systems, the dangers associated with such bursting cores cannot be averted. The flying core parts can be thrown far beyond the customary pivoting and motion area for the material rolls, which normally indicates the size of the area to be secured. An alarm, that would be triggered by a sensor detection of a core break, would not warn the persons inside the danger area until it was too late. Such persons would not be able to avoid the core parts that would be torn out of the holder at high speed.

Under normal operating conditions for printing presses, and especially for newspaper printing presses, persons can remain within the danger area for a core break or core burst Accordingly, when high speeds are used in such printing presses, it is necessary to take special safety precautions, in order to protect these persons, along with sensitive equipment and devices that are apt to be in such a danger area.

DE 100 08 221 A1 describes a roll changer with a roller grid, which is opened and closed based upon various operating conditions for the machine.

DE 103 46 984 A1 and CH 377 250 A disclose roller-type protective devices.

SUMMARY OF THE INVENTION

The object of the present invention is to provide a device for covering a danger area of a roll changer and also to provide a method for controlling a device.

The object is attained according to the invention with the provision of a roll changer having a protective cover, a drive that is usable to move that protective cover and a control unit for the drive. The protective cover is closed in a first operational position and is open in a second operational position. The material roll supported by the roll changer has a first speed in the closed, first operational position, and has a second rotational speed in the open, second operational position. The web rotation speed is greater than 0 in the second operational position.

The benefits to be achieved in accordance with the present invention consist especially in that a simple mechanical security system protects operating personnel from core parts that could possibly be thrown out of the roll changer in the case of a core burst. The security system of the present invention does not impede the view of a press operator into the roll changer. The ability of the press operator to intervene when a danger is identified, in order to potentially avoid greater harm by stopping the machine early or by reducing the speed of the machine, is preserved.

By using a roller grid as a protective cover, the costs of the device can be kept low, because existing and economical roller grid structures can be used. Roller grids, which are generally known, consist, for example, of metal profiled pieces, which are capable of withstanding high forces but which have a low weight. The use of such a roller grid also makes it possible to rapidly open and close the protective cover. Furthermore, roller grids can be rolled up into a small space, so that the dimensions of the roll changer to be secured are not excessively increased.

Other forms of protective covers are also possible. Examples are plastic curtains, draped grids, which can be moved to the side, downward, or upward out of the area to be secured, or nets which may be made of tear-resistant fabrics, and which are capable of being moved in a manner comparable to the roller grids.

BRIEF DESCRIPTION OF THE DRAWINGS

One preferred embodiment of the present invention is represented in the set of drawings, and will be described in greater detail in what follows.

The drawings show in.

DESCRIPTION OF THE PREFERRED EMBODIMENTS

Figure 1:
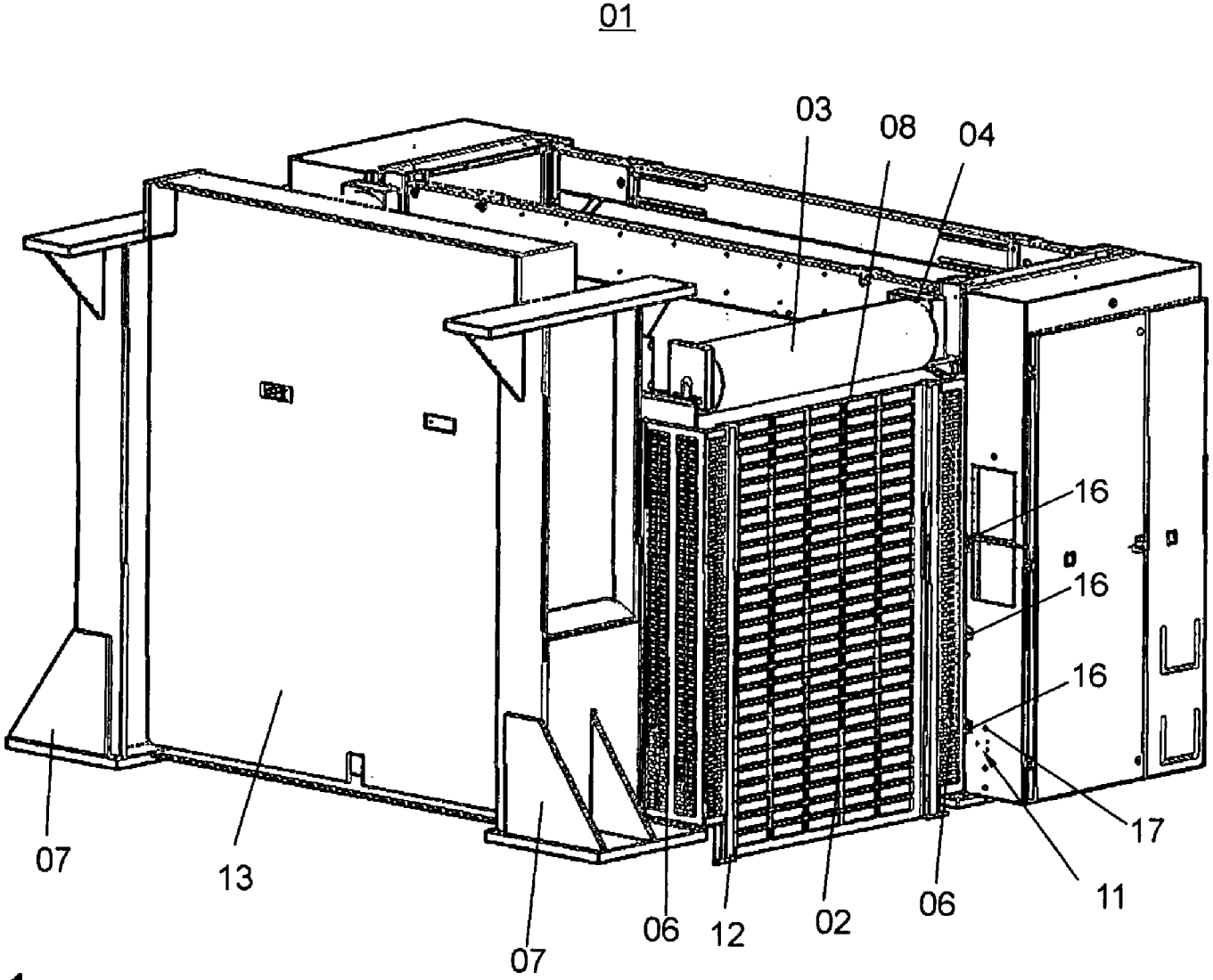
FIG. 1 a perspective view of a roll changer with a device for covering a danger area of the roll changer in accordance with the present invention.

FIG. 1 shows a perspective view of a roll changer 01 with a device, which is preferably configured as a protective cover 02, such as, for example, a roller grid 02. In the discussion which follows, a method for controlling the device will also be specified within the context of this depiction shown in FIG. 1.

The roller grid 02 can be rolled up onto a grid roll 03, which grid roll 03 can be actuated in two rotational directions via a roll drive 04. The roller grid 02 is connected via grid guides or grid guards 06, or by other connecting elements, to the roll changer 01 on a first side of the roller grid 02 and to a support 07 on the other side of the roller grid 02. Suitable roller grids 02 are preferably arranged at all access points or feed openings to the roll changer 01, so that personnel cannot enter the danger zone, in which danger zone parts of a broken core could be thrown around in the case of a core burst.

The protective cover 02 can also be configured, for example, as a heavy foil or as a wire grid, which protective cover 02 can either be rolled up on a roll 03 or can simply be lowered from above. or which can also be drawn out of a well. The protective cover 02 could also be structured as a single- or double-sided gate, if sufficient pivoting space is available to open the feed opening at the roll changer 01 to permit a roll change.

The protective cover 02 is closed in a first operational position and is open in a second operational position. As discussed above, the specific form of the protective cover 02 is variable.

Figure 2:
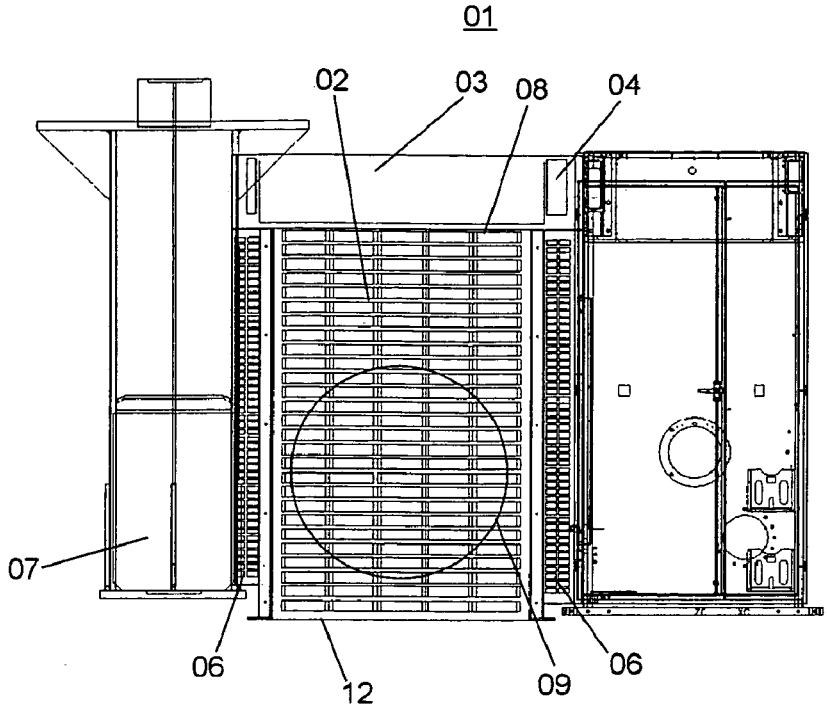
in FIG. 2 a side elevation view of the roll changer according to FIG. 1.

In the closed, first operational position, as depicted in FIG. 1, a material roll 09, which, as seen in FIG. 2, is held in the roll changer 01, has a first rotational speed and/or a first web speed typically of greater than or equal to 9 m/s, and preferably of 10 m/s or 11 m/s or 12 m/s or 13 m/s. In the open, second operational position, which is not specifically depicted, the material roll 09 has a second rotational speed or web speed, which is greater than 0. This second speed is less than 13 m/s or less than 12 m/s or less than 11 m/s or less than 10 m/s or less than 9 m/s, or is greater than 1 m/min or greater than 2 m/min or greater than 5 m/min or greater than 10 m/min or greater than 25 m/min or greater than 50 m/min.

In an initial position, the roller grid 02 is open, and actuates an upper limit switch 08, as seen in FIGS. 1 and 2. When a material roll 09, which is not specifically shown in FIG. 1, has expired, the roller grid 02 must be closed as soon as the actual rotational speed of the material roll 09 exceeds a critical rotational speed, such as, for example, a pre-established first web speed. The critical rotational speed of the material roll 09 is determined such that when this critical rotational speed has been reached, enough time still remains that the roller grid 02 can be closed before a rotational speed is reached, at which higher rotational speed a core break cannot be excluded, with the necessary level of certainty.

The actual rotational speed of the material roll 09 is detected by the use of a suitable speed sensor, which is not specifically shown, or is determined from the measured web speed and the also determined remaining diameter of the material roll 09, or may be determined by a virtual guide axis, and is transmitted to a control unit which is also not specifically shown. Once the actual rotational speed of the material roll 09 has reached the critical speed or has reached an adequate web speed, a scan is performed to determine the status of a zone safety system 11. When the zone safety system 11 signals that the space required to close the roller grid 02 is free, the control unit activates the roll drive 04 in the closure direction, causing the roller grid 02 to be lowered. The zone safety system 11 can be configured in a generally known manner.

The zone safety system 11 has one or more sensors 16, especially photo cells or a laser array and/or also includes additional sensors 17 for a so-called muting function.

Muting refers to a temporary automatic suspension of a safety function, and refers especially to the bypassing of a safety device by safety-related components of a control system; such as, for example temporarily accelerating a material roll when protective devices on the roll changer 01 are open, or allowing a material roll to pass through the area of the roll changer that is protected by sensors.

The sensors 16 primary purpose are to determine the presence of a person in the area of the roll changer 01, and especially the presence of a person in the area of the roller grid 02.

Should the zone safety system 11 signal that a person or an object is present within the area of movement of the device, the system cannot be switched to the closed position. In this case, the control unit prevents the rotational speed of the core and/or of the material roll 09 from being increased beyond the established critical speed or beyond a predetermined maximum allowable speed for operation without such a device. This can be achieved either by reducing the web speed of the material web running off the material roll, or by completely interrupting the printing process and by stopping the material roll 09.

When the roller grid 02 is fully lowered, a lower limit switch 12 is actuated. With this step, a CLOSED status is detected in the control unit. Similarly, when the upper limit switch 08 is actuated, an OPEN status is detected. If the CLOSED status is not reached within a predetermined closure period, following initiation of the closure process, such as, for example, because an operator is present inside this area or the roller grid 02 is blocked, the roll speed is reduced to a maximum allowable speed, or is held at this speed, which maximum allowable is below the speed that is necessary for a possible core break. The closure period is preferably a value that is specifically preset in the control unit, and is a value that is adjusted to the time which is required for the accomplishment of a normal closure process.

When the CLOSED status is reached, the rotational speed of the material roll 09 can be further increased, so that processing can continue for a longer period of time, with a smaller remaining roll diameter, at a high web speed. The danger of a possible core break, when a material roll 09 is nearly expired, even though such a core break occurs only rarely, is acceptable when the protective cover 02 is closed.

Once the rotational speed of the material roll 09 drops back below the critical speed, when the material roll 09 is being decelerated, the roller grid 02 can be reopened, with the roll drive 04 receiving a corresponding command from the control unit to initiate this roller grid 02 opening process.

The zone safety system 11 is also scanned prior to opening of the roller grid 02. This is done in order to prevent an operator from accidentally colliding with the opening roller grid 02. This is particularly important when the roller grid 02 is being opened rapidly and/or, in modified embodiments, when the protective cover 02 is being pivoted laterally.

The motion speeds of the protective cover 02, and especially the rotational speed of the grid roll 03, is variable and is preferably recalculated each time, so that after the protective cover 02 has been closed, sufficient time remains to slowly decelerate the machine, such as, for example in the case of a functional failure of the protective cover 02.

The area between the supports 07 is filled by a partition wall 13. A roller grid 02 can also be installed in this area, in a manner similar to that which has already been described above.

The monitoring of the speed and the control of the device are performed in a fail-safe manner. Safety-related parts must be configured such that a single failure of one of these parts will not lead to a failure of the safety function.

Figure 3:
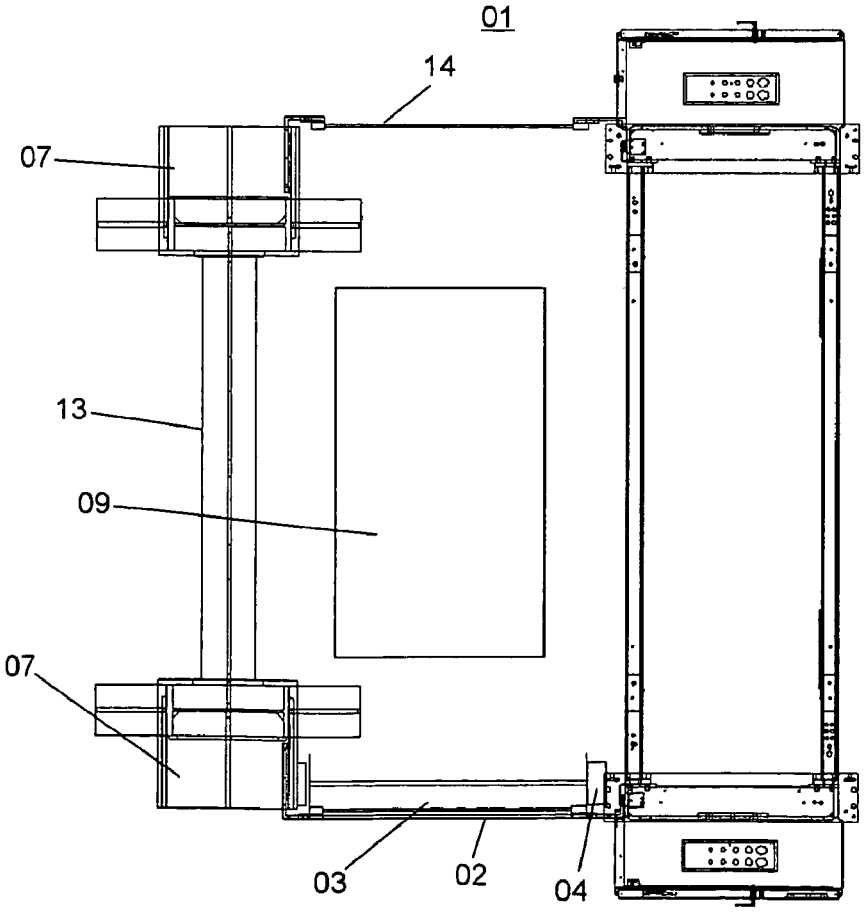
in FIG. 3 a top plan view of the roll changer according to FIG. 1.

FIG. 2 and FIG. 3 also show the roll changer 01 of FIG. 1, but from a side view and a top plan view, respectively. In these depictions, the material roll 09 that is clamped in the roll changer 01 is also shown. It is apparent in FIG. 3 that a stationary protective panel 14 is arranged opposite the movable roller protective grid 02 that is situated on the other end surface of the material roll 09. In modified embodiments, this protective panel 14 could also be replaced by a movable roller grid 02.

The roll changer 01 is preferably arranged in a web-fed rotary printing press. The web-fed rotary printing press typically prints the material web both at the first web speed and at the second web speed.

Figure 4:
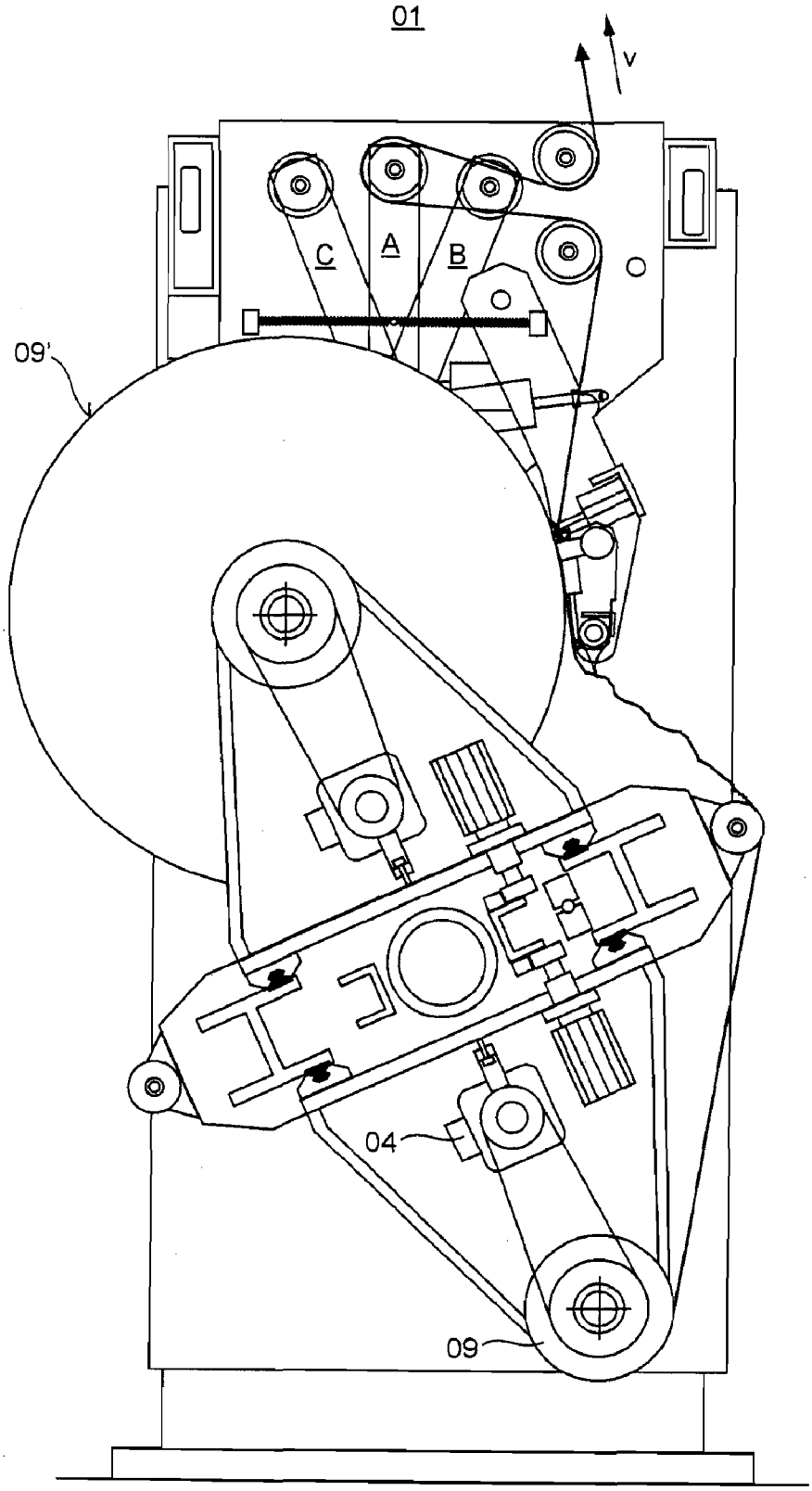
in FIG. 4 a schematic side elevation view of the roll changer without its protective cover; and in FIG. 5 a cross-sectional view of the roll changer according to FIG. 4.

The roll changer is configured to accommodate at least two material rolls 09; 09', such as at least one new material roll 09' and at least one expiring material roll 09, which two material rolls 09; 09' can be exchanged using the "flying" roll change process, as may be seen in FIG. 4.

Figure 5:
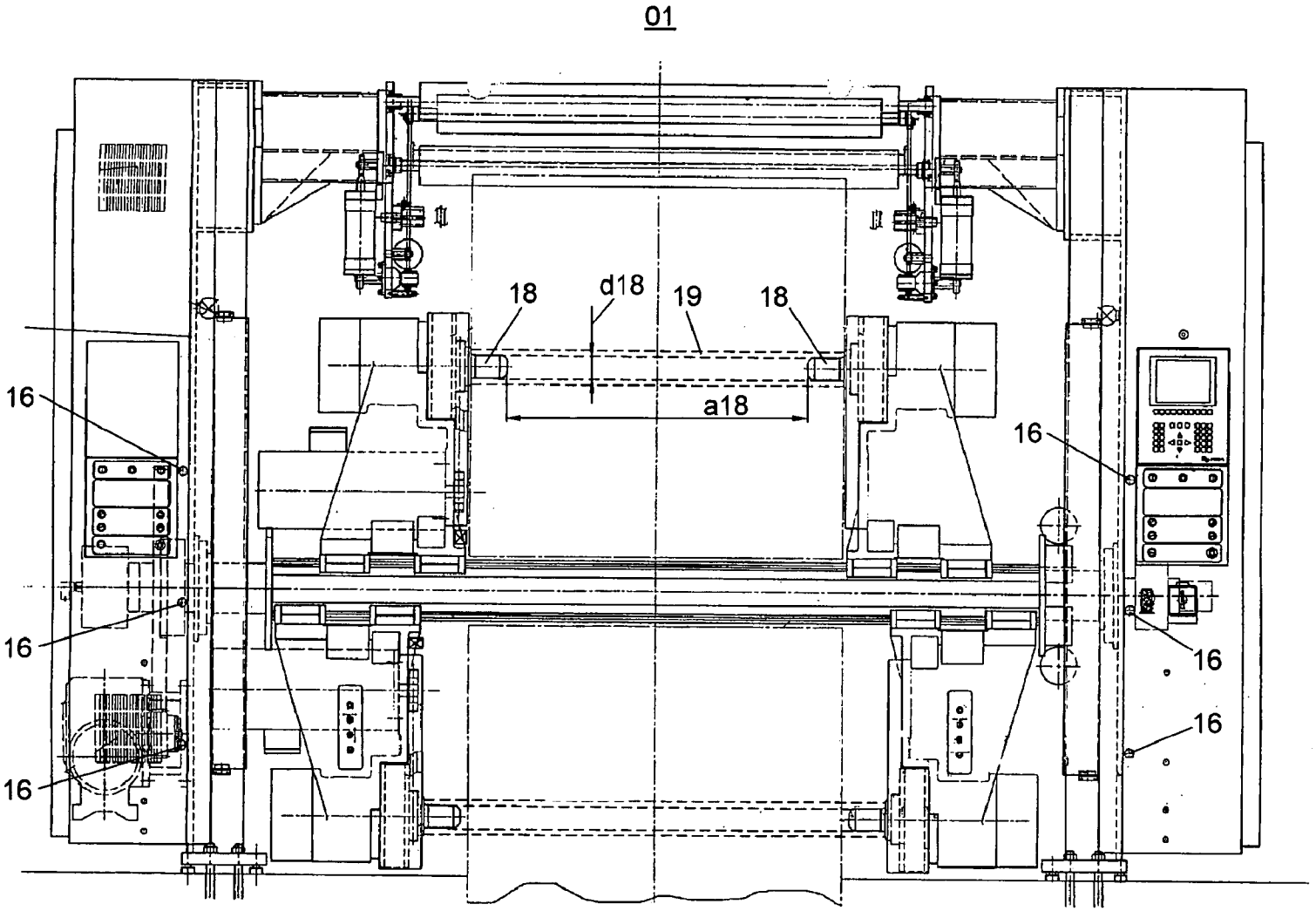

As is shown in FIG. 5, the roll changer 01 has at least one roll core mount 18 on each support arm, which at least one roll core mount 18 is preferably configured as a clamping cone 18.

The depicted material roll 09, which is equipped, for example, with a roll core 19, is held by two such clamping cones 18, wherein the clamping cones 18 are spaced apart at a distance "a18" of at least 1,800 mm and have a diameter "d18" of 70 to 80 mm. With the use of such support arms and clamping cones 18, a material roll 09 having a width of greater than 2,000 mm and a core 19 having an internal diameter of approximately 73-77 mm can be accommodated.

While preferred embodiments of a device for covering a danger area on a roll changer and a method for controlling such a device, in accordance with the present invention, have been set forth fully and completely hereinabove, it will be apparent to one of skill in the art that various changes in, for example, the specific drive for the printing press, the drive for the roll changer, and the like could be made without departing from the true spirit and scope of the present invention which is accordingly to be limited only by the appended claims.

What is claimed is:

1. A device adapted to cover a danger area of a roll changer comprising:

means on said roll changer to support at least one material roll for rotation and to drive said at least one material roll for rotation at a first rotational speed and at a second rotational speed less than said first rotational speed and greater than 0;

a protective cover to selectively allow access to said roll support means in an open operational position and to prevent access to said roll support means in a closed operational position;

a protective cover drive to move said protective cover between said closed, operational position and said open, operational position; and a control unit for said protective cover drive, wherein when said material roll has said first rotational speed, said control unit for said protective cover drive operates said protective cover drive to move said protective cover to said closed operational position and when said material roll has said second rotational speed, said control unit for said protective cover drive operates said protective cover drive to move said protective cover to said open operational position.

2. The device of claim 1 wherein said protective cover is a roller grid.

3. The device of claim 2 further including grid guides and wherein said grid guides connect said roller grid and said roll changer.

4. The device of claim 1 further including a roll driven by said protective cover drive and wherein said protective cover is rolled up on said roll.

5. The device of claim 4 further including an access point for said roll changer and wherein said roll is arranged above said access point.

6. The device of claim 1 wherein said protective cover is one of plastic rollable curtains, and draped grids and tear resistant fabric nets.

7. The device of claim 1 further including a zone safety system having at least one sensor.

8. The device of claim 7 wherein said zone safety system is adapted to issue a release signal to said control unit to close said protective cover when a motion area of said zone safety system is unblocked.

9. The device of claim 1 further including an upper limit switch and a lower limit switch adapted to be scanned by said control unit to identify closed and open positions, respectively of said protective cover.

10. The device of claim 1 wherein said roll changer is in a web-fed rotary printing press.

11. The device of claim 10 wherein said web-fed rotary printing press prints a material web which is wound off said material web at said first rotational speed and at said second rotational speed.

12. The device of claim 1 wherein two of said material rolls can be positioned in said roll changer.

13. The device of claim 12 wherein said roll changer rolls said material web off a first of said at least two material rolls and supports a second of said at least two material rolls as a new material roll.

14. The device of claim 1 further including a roll core in said material roll and wherein said means to support said at least one material roll includes roll core mounts to engage said roll core.

15. The device of claim 14 wherein each of said roll core mounts has an external diameter between 70 mm and 80 mm.

16. The device of claim 14 wherein said two roll core mounts are spaced apart from each other at a roll core support spacing distance of at least 1800 mm.

17. The device of claim 1 wherein a form of said protective cover is adjustable.

18. The device of claim 1 wherein said protective cover has a first form in said closed, operational position and a second form, different from said first form, in said second operational position.

19. A method for controlling a device on a roll changer including:

providing a protective cover for an access point for said roll changer as said device;

detecting an open status of said protective cover;

providing a roll of material;

supporting said roll of material for rotation in said roll changer;

determining an actual roll speed of said roll of material;

evaluating said actual speed of said roll of material;

issuing a closure signal for said protective cover when said actual speed of said roll of material reaches a predetermined first speed;

detecting a closed status of said protective cover within a predetermined closure period after said issuing of said closure signal; and reducing said actual speed of said roll of material to a second roll speed greater than 0 if said closed status of said protective cover is not detected before the expiring of said closure period.

20. The method of claim 19 further including issuing an opening signal when said actual speed of said roll of material is less than said predetermined first speed.

21. The method of claim 19 further including providing a zone safety system and evaluating a release signal from said zone safety system.

22. The method of claim 21 further including issuing a selected one of said closure signal and said opening signal when said release signal is indicating that said access point is unblocked.

23. The method of claim 19 further including determining said actual roll speed of said roll of material by one of directly using a sensor and indirectly by using web speed.

24. The method of claim 19 further including increasing said actual roll speed of said roll of material beyond said predetermined first roll speed after detecting said closed status.

25. The method of claim 19 further including determining a possible material roll core break speed and selecting said second roll speed less than said material roll core break speed.

26. The method of claim 19 further including selecting said second roll speed less than 13 m/s.

27. The method of claim 19 further including selecting said second roll speed less than 12 m/s.

28. The method of claim 19 further including selecting said second roll speed less than 11 m/s.

29. The method of claim 19 further including selecting said second roll speed less than 10 m/s.

30. The method of claim 19 further including selecting said second roll speed less than 9 m/s.

31. The method of claim 19 further including selecting said actual roll speed greater than 9 m/s.

32. The method of claim 19 further including selecting said actual roll speed greater than 10 m/s.

33. The method of claim 19 further including selecting said actual roll speed greater than 11 m/s.

34. The method of claim 19 further including selecting said actual roll speed greater than 12 m/s.

35. The method of claim 19 further including selecting said actual roll speed greater than 13 m/s.

36. The method of claim 19 further including selecting said second roll speed greater than 1 m/min.

37. The method of claim 19 further including selecting said second roll speed greater than 2 m/min.

38. The method of claim 19 further including selecting said second roll speed greater than 5 m/min.

39. The method of claim 19 further including selecting said second roll speed greater than 10 m/min.

40. The method of claim 19 further including selecting said second roll speed greater than 25 m/min.

41. The method of claim 19 further including selecting said second roll speed greater than 50 m/min.

* * * * *